US005526882A

United States Patent [19]

Parks et al.

[11] Patent Number: 5,526,882

[45] Date of Patent: Jun. 18, 1996

[54] SUBSEA DRILLING AND PRODUCTION TEMPLATE SYSTEM

[75] Inventors: William C. Parks, Katy; Walter S. Going, III, Houston, both of Tex.

[73] Assignee: Sonsub, Inc., Houston, Tex.

[21] Appl. No.: 375,548

[22] Filed: Jan. 19, 1995

[51] Int. Cl.[6] ..... E21B 7/128

[52] U.S. Cl. ..... 166/339; 166/358; 166/366; 175/7; 405/203; 405/227

[58] Field of Search ..... 166/339, 358, 166/366; 175/7; 405/203, 224, 227

[56] References Cited

U.S. PATENT DOCUMENTS

| | | | |
|---|---|---|---|
| 3,618,661 | 11/1971 | Peterman | 175/7 X |
| 3,779,313 | 12/1973 | Regan | 166/360 |
| 4,190,120 | 2/1980 | Regan | 175/7 |
| 4,435,108 | 3/1984 | Hampton | 175/7 |
| 4,437,521 | 3/1984 | Richardson et al. | 166/366 X |
| 4,439,068 | 3/1984 | Pokladnik | 405/188 X |
| 4,444,275 | 4/1984 | Beynet et al. | 175/7 |
| 4,445,807 | 5/1984 | Cowan | 405/199 X |
| 4,540,314 | 9/1985 | Falkner | 405/224 X |
| 4,625,806 | 12/1986 | Silcox | 166/358 |
| 4,784,527 | 11/1988 | Hunter et al. | 405/207 |
| 4,822,212 | 4/1989 | Hall et al. | 405/227 |

OTHER PUBLICATIONS

Sonsub Brochure — Subsea Production Systems "The Innovators of Subsea and Remote Systems Technology" May 1993.

Technology — "Stacked Subsea Templates Accelerate Deepwater Development" Oil & Gas Journal, Oct. 21, 1991, pp. 69–71.

*Primary Examiner*—Roger J. Schoeppel

*Attorney, Agent, or Firm*—Pravel, Hewitt, Kimball & Krieger

[57] ABSTRACT

An improved subsea template system. A drilling template is adapted to rest on the seafloor. The drilling template includes at least one conductor guide through which a well is drilled. An alignment structure is attached to the top of the conductor guide and fits within a conductor guide of a production template. The production template includes at least one conductor guide more than the drilling template. Once engaged, the alignment sleeve serves to coaxially align the conductor guide of the drilling template with a corresponding conductor guide of the production template.

4 Claims, 4 Drawing Sheets

FIG.1
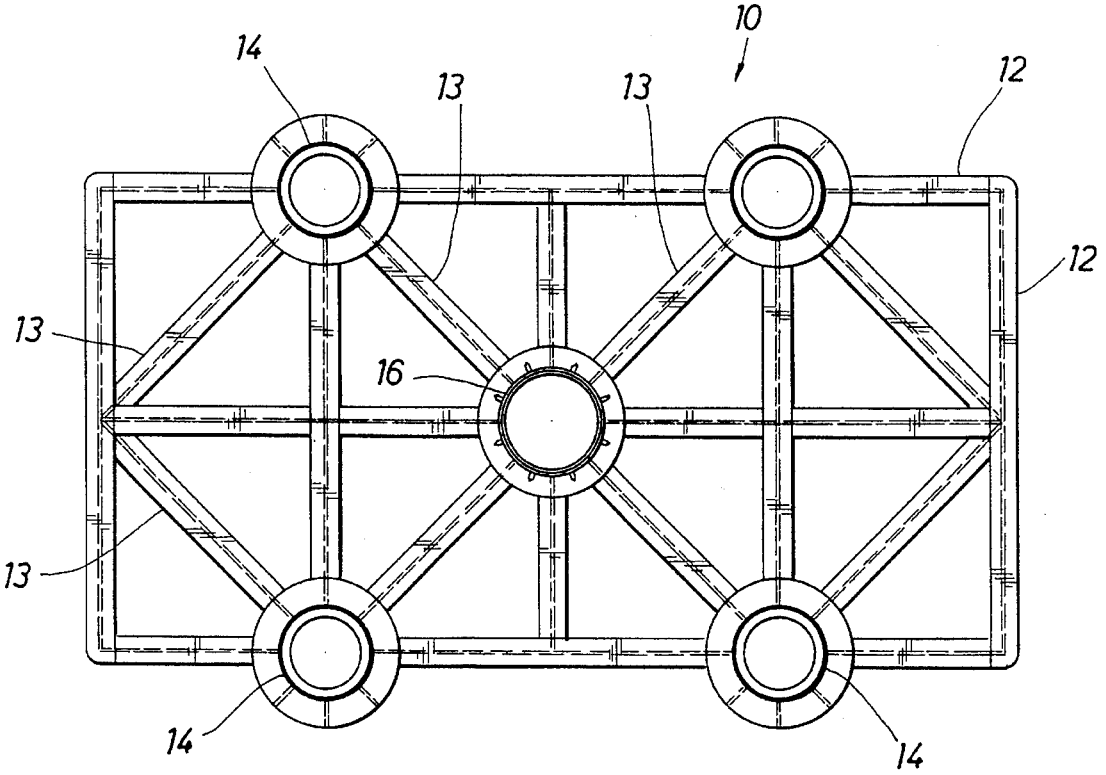
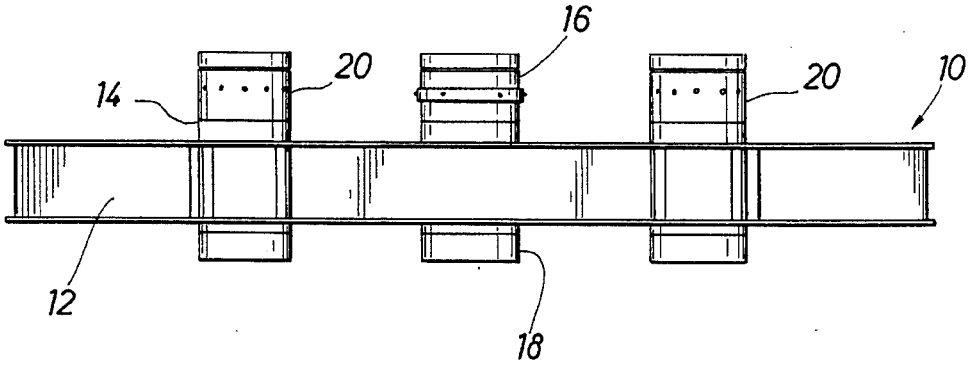
FIG. 2

7
26B
26A
10
24
26
16
27
13
12
26C
28
28
26D
7

20A
26A
20
26
14
24
18
10
27
12
20D

SUBSEA DRILLING AND PRODUCTION TEMPLATE SYSTEM

BACKGROUND OF THE INVENTION

1. Field of the Invention

This invention relates to an improved subsea template system. More specifically, this invention relates to an improved subsea production template system which permits the mateable engagement of a production template onto a drilling template.

2. Description of the Prior Art

Subsea oil and gas well drilling templates enable a drilling operator to accurately position the drilling of particular wells through conduit members into an oil or gas reservoir. Following drilling operations, a production template may be installed which may include additional production equipment. There is a need, however, for a design which is flexible enough to accommodate additional wells beyond those which were originally drilled through the drilling template. This may be necessary, for example, if additional wells are required to develop the reservoir or if the original wells are no longer producing.

SUMMARY OF THE INVENTION

Briefly, the invention is an improved subsea template system having a drilling template adapted to rest on the seafloor. The drilling template would include at least one conductor guide through which a well is drilled. The drilling template may include any number of conductor guides, depending upon the needs of the operator. In addition, the present invention includes means for securing the drilling template to the seafloor and at least one alignment sleeve that is attached at its lower end to a conductor guide of the drilling template. Each conductor guide of the drilling template may have its own alignment sleeve as well. In this manner, a production template, having at least one more conductor guide than the drilling template, may be lowered onto the drilling template so that all conductor guides of the drilling template are coaxially aligned by means of the alignment sleeves with some of the conductor guides of the production template. Each alignment sleeve includes means for engaging the production template in a fixed manner thereby securing the production template to the drilling template and thus to the seafloor.

The more important features of this invention have been summarized rather broadly in order that the detailed description may be better understood. There are, of course, additional features of the invention which will be described hereafter and which will also form the subject of the claims appended hereto.

BRIEF DESCRIPTION OF THE DRAWINGS

FIG. 1 is a plan view of a drilling template of the present invention.

FIG. 2 is an elevation view of the drilling template of the present invention.

DETAILED DESCRIPTION OF PREFERRED EMBODIMENT

Figure 3:
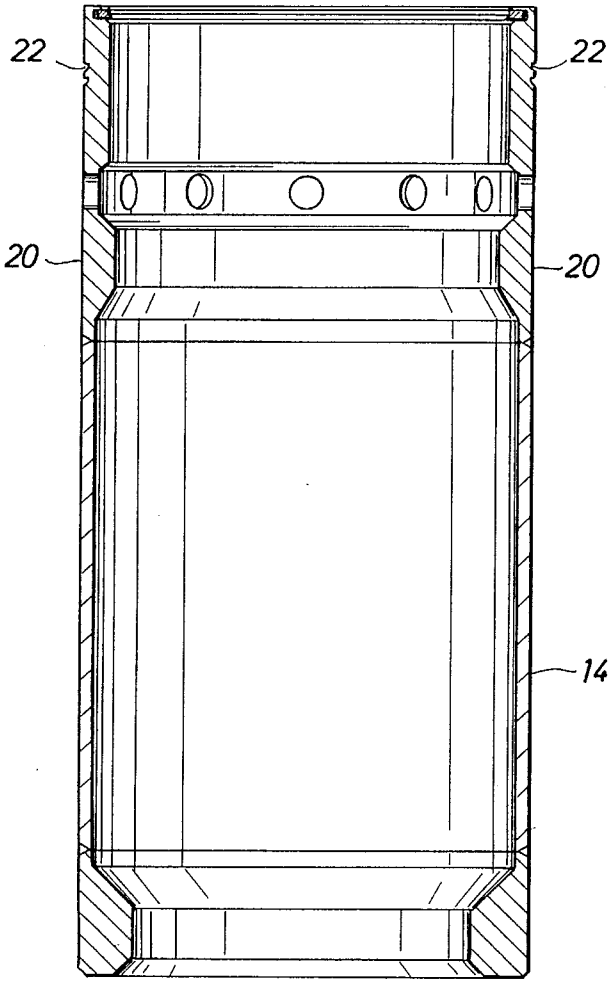
FIG. 3 is a cross-sectional view of an alignment sleeve of the present invention.

Referring now to FIGS. 1–3 a drilling template 10 is shown which is submerged and rests on the seafloor. The template 10 is comprised of a series of longitudinal beams 12 and diagonal beams 13 which provide structural rigidity. Conductor guides 14 are shown at the approximate four corners of template 10. A central sleeve 16 is positioned at the center of template 10. Guides 14 and sleeve 16 are an integral part of template 10 since beams 12 and 13 are welded directly thereto.

Template 10 is lowered to the seafloor and held in place by a pile 18 previously driven or jetted into the seafloor. The template is oriented relative to the seafloor and held laterally by engaging sleeve 16 with pile 18. Wells are then drilled from a surface vessel through each guide 14 into the seafloor. Such drilling techniques are well known to those skilled in the art.

Referring now to FIGS. 2 and 3, An alignment sleeve 20 is attached to the top end of each conductor guide 14. Alignment sleeve 20 extends above guide 14 and above the frame of template 10. A groove 22 is peripherally positioned about alignment sleeve 20.

Figure 4:
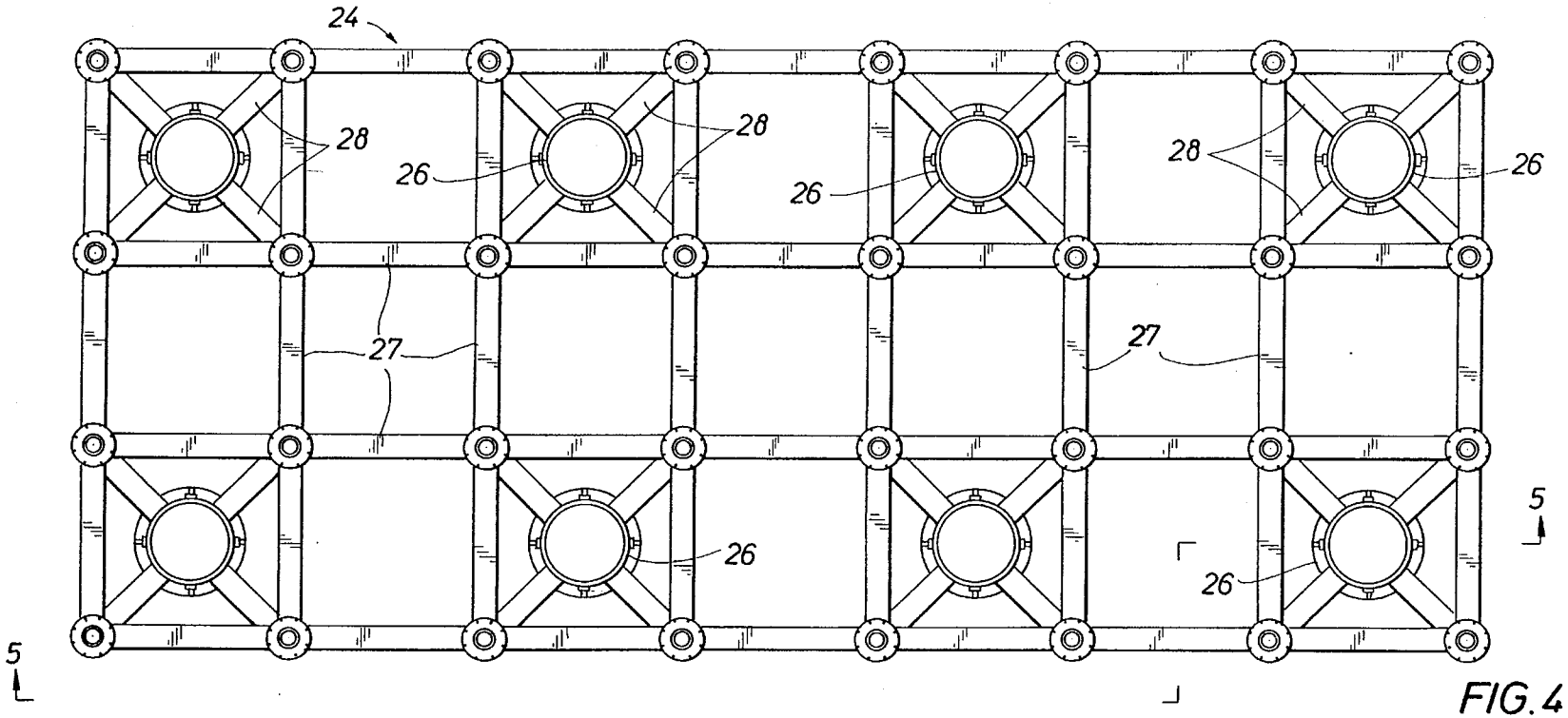
FIG. 4 is a plan view of a production template of the present invention.
Figure 5:
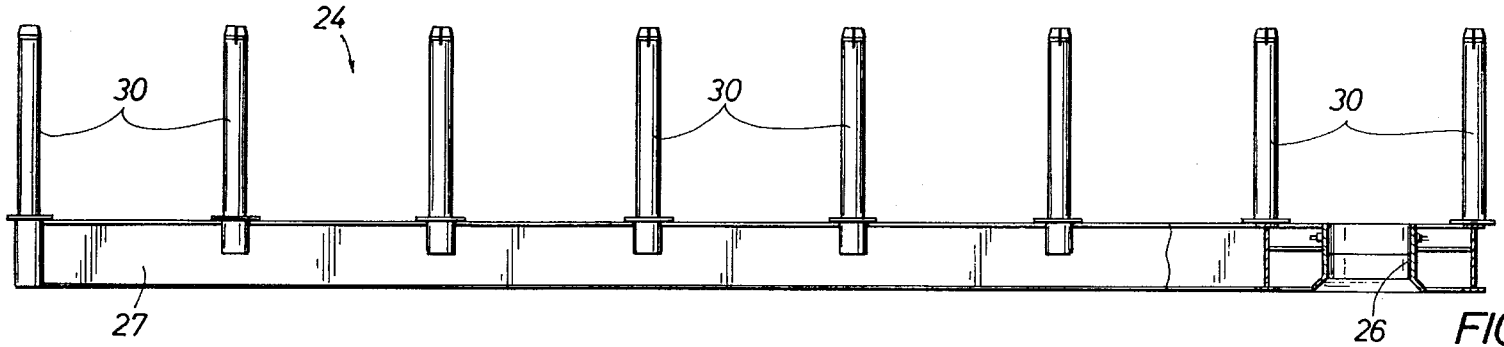
FIG. 5 is a cross-sectional view taken along line 5—5 of FIG. 4 of the present invention.

Referring now to FIGS. 4 and 5, a production template 24 is shown having a series of conductor guides 26 supported within a framework comprised of longitudinal beams 27 and diagonal beams 28. As in the case of drilling template 10, conductor guides 26 are an integral part of template 24 since beams 28 are welded directly thereto. Production template 24 may include upper members 30 which serve to provide lateral workpieces for the location of additional production equipment (not shown).

Figure 6:
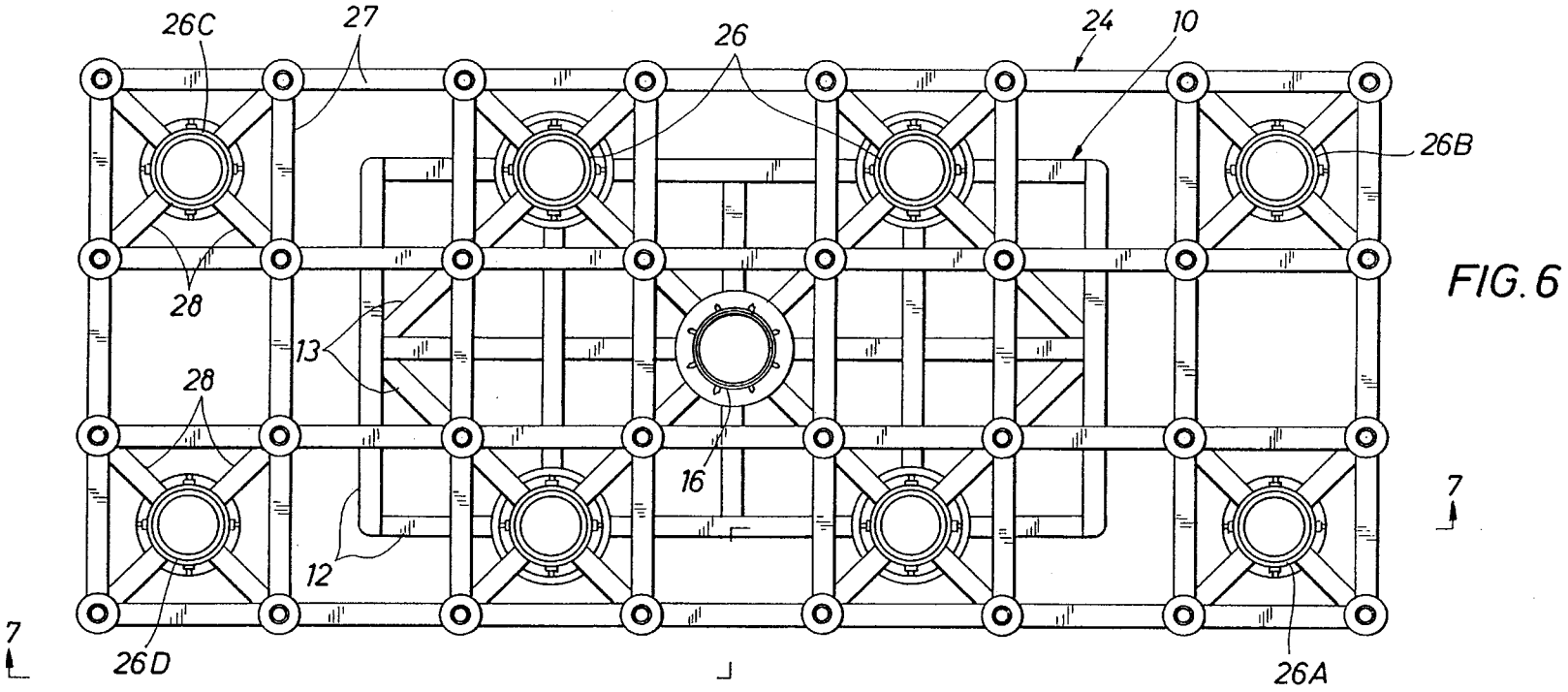
FIG. 6 is a plan view of the production template and the drilling template of the present invention.
Figure 7:
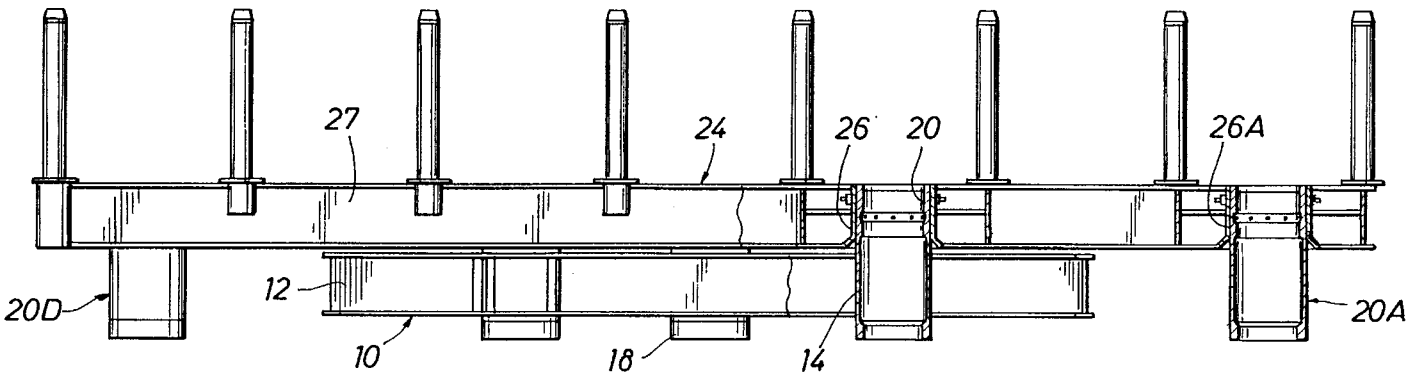
FIG. 7 is a cross-sectional view taken along line 7—7 of FIG. 6.

Referring now to FIGS. 6 and 7, production template 24 is shown in mating engagement with drilling template 10. Conductor guides 14 originally positioned as shown in FIG. 2 are matingly engageable with conductor guides 26 of production template 24 via alignment sleeves 20. As shown, drilling template 10 includes only four conductor guides 14. However, drilling template 10 may include any number of guides 14 provided that production template 24 has at least one more conductor guide 26 than corresponding drilling template 10, thereby enabling the drilling of additional wells beyond those originally drilled through drilling template 10.

Referring back briefly to FIGS. 1 and 2, four conductor guides 14 are shown and, therefore, four alignment sleeves 20 are used. These same four alignment sleeves 20 are also shown in FIGS. 6 and 7. Further, as shown in FIGS. 6 and 7, production template 24 may also accommodate additional alignment sleeves 20A which are located in each of the four outer corner conductor guides 26 for which there is not a corresponding conductor guide 14 in the drilling template 10, i.e., guides 26A–26D. In this manner, once production template 24 is engaged onto drilling template 10, additional guides 26A–26D are available for the drilling of additional wells if necessary at some time. Obviously, the number of additional conductor guides in a production template may vary depending on the circumstances and is not limited to a specific maximum number or the configuration shown in FIGS. 4 and 6.

Figure 8:
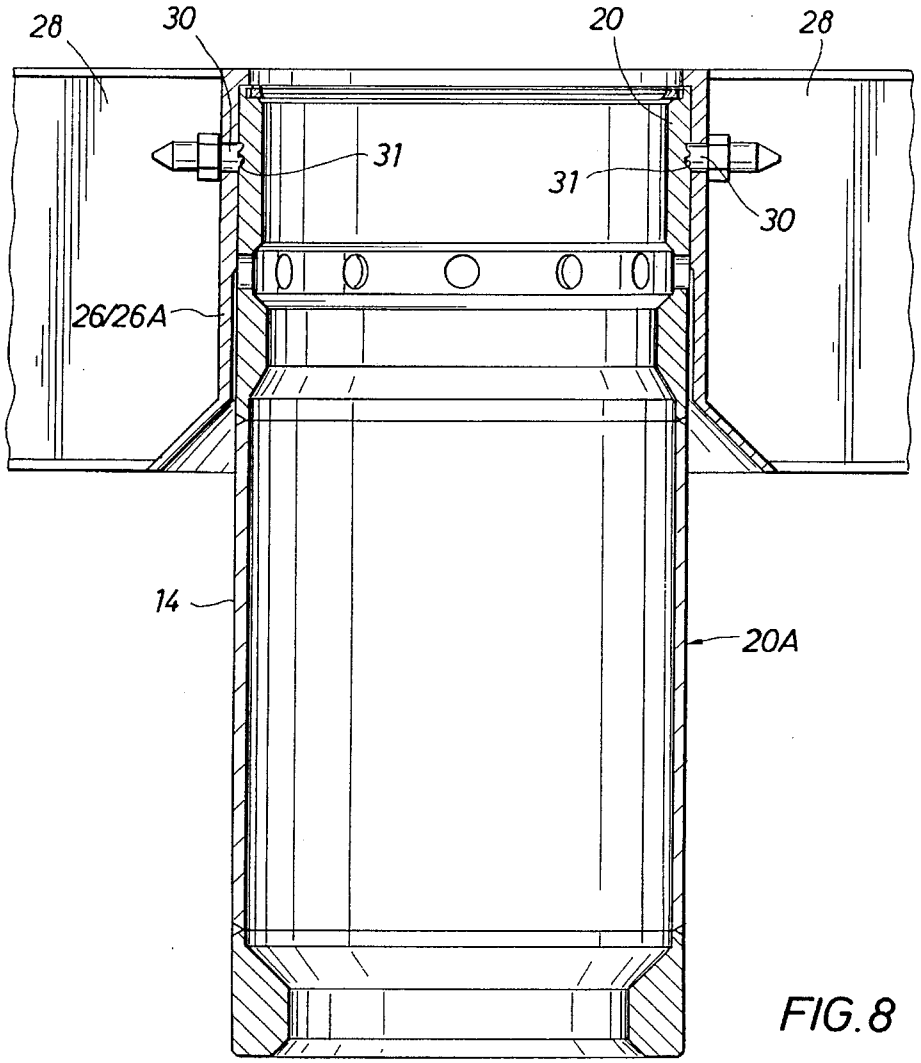
FIG. 8 is a detailed cross-sectional view of the assembly sleeve in a mateable engagement with the production template.

Referring now to FIG. 8, an alignment sleeve 20A is shown typical of those set within each of the outer conductor guides 26A–D of production template 24. Each alignment sleeve 20A includes an upper portion 20 which is similar to that shown in FIG. 3 and a lower cylindrical portion 14 which is similar to that shown in FIGS. 1–3. When sleeve 20A is installed outboard of drilling template 10 within corner guides 26A–D of production template 24, it serves as a conductor guide for the drilling of additional wells.

Referring now to FIGS. 3 and 8, each alignment sleeve 20 is firmly engaged within production template 24 through the activation of a dog member 30 having ridges 31. Member 30 is moved radially inwardly to engage groove 22. Ridges 31 mate within grooves 22. In this manner, dog member 30 serves as a lock to releasably secure drilling template 10 to production template 24. Any number of dog members 30 may be used depending upon the loading requirements and such members may be hydraulically, mechanically or electrically operated. The incorporation and activation of such dogs within a subsea environment are well known to those in the art.

In operation, drilling template 10 is first lowered to the seafloor and engages pile 18. Following drilling, production template 24 is lowered onto the drilling template. Alignment sleeves 20 which are attached to conductor guides 14 of drilling template 10 engage with similarly oriented guides 26 of production template 24. Dog members 30 are activated which firmly seat within grooves 22 of sleeves 20. In this manner, production template 24 is securely engaged to the drilling template. Production template 24 also includes alignment sleeves 20A positioned within those guides 26 for which there is not a guide 14 of drilling template 10 (guides 26A–D in FIG. 6). Thus, another guide is provided for the drilling of an additional well at some time in the future, if needed.

Production template 24 may include any number of guides 26 in any configuration so long as it includes at least the capability of drilling one more well than the drilling template permits. There are, of course, additional variations and alterations to the embodiment set forth herein based on the disclosure provided. It is intended that all such equivalent modifications and variations fall within the spirit and scope of the claims appended hereto.

What is claimed is:

1. An improved subsea template system comprising:

a first template adapted to rest on the seafloor, the template having at least one conductor guide;

means for securing said first template to the seafloor;

a second template having at least one conductor guide more than the number of conductor guides of said first template;

at least one alignment sleeve, said alignment sleeve attached to said conductor guide of said first template and having means for engaging said second template so as to coaxially align said conductor guide of said first template with said conductor guide of said second template; and a releasable lock mounted proximate said conductor guide of said second template for releasably locking said engaging means of said alignment sleeve so as to secure said first template to said second template.

2. An improved subsea template system comprising:

a first template adapted to rest on the seafloor, said template having a plurality of conductor guides;

means for securing said first template to said seafloor;

a second template having at least one more conductor guide than the number of conductor guides of said first template; and a plurality of alignment sleeves, one said alignment sleeve attached to each of said conductor guides of said first template, each said alignment sleeve having means for engaging a corresponding conductor guide of said second template so as to coaxially align said corresponding guide of said second template with said conductor guide of said first template.

3. The improved subsea template system according to claim 2 wherein said system further comprises means for guiding the drilling of additional wells through said conductor guides of said second template which are not coaxially aligned with a corresponding conductor guide of said first template.

4. The improved subsea template system according to claim 2 wherein said system further comprises a releasable lock mounted proximate each said conductor guide of said second template for releasably locking said engaging means of each said alignment sleeve so as to secure said first template to said second template.

* * * * *